US005885164A

United States Patent [19]

Wheatley

[11] Patent Number: 5,885,164

[45] Date of Patent: Mar. 23, 1999

[54] GOLF PRACTICE AID

[76] Inventor: W. George Wheatley, 25 Farringford Dr., Brantford, Ontario, Canada, N3R 6K4

[21] Appl. No.: 103,706

[22] Filed: Jun. 24, 1998

[51] Int. Cl.[6] ..... A63B 69/36

[52] U.S. Cl. ..... 473/143; 473/145

[58] Field of Search ..... 473/143, 145, 473/144, 146, 147, 148, 149

[56] References Cited

U.S. PATENT DOCUMENTS

| | | | |
|---|---|---|---|
| 1,936,687 | 11/1933 | Pottle | 473/143 |
| 3,143,351 | 8/1964 | Bertrand | 473/143 |
| 3,298,232 | 1/1967 | Carboni . | |
| 3,430,493 | 3/1969 | Wall, Sr. . | |
| 3,494,621 | 2/1970 | Windall . | |
| 4,014,552 | 3/1977 | Watson . | |
| 4,071,250 | 1/1978 | Vroome . | |
| 4,119,318 | 10/1978 | de Kremer et al. . | |
| 4,971,326 | 11/1990 | Montone . | |
| 4,986,551 | 1/1991 | Langlors | 473/147 |
| 5,116,059 | 5/1992 | Pelletier . | |
| 5,156,400 | 10/1992 | Nemeth . | |
| 5,460,380 | 10/1995 | Ober . | |
| 5,560,604 | 10/1996 | Watts . | |

*Primary Examiner*—George J. Marlo

[57] ABSTRACT

This invention relates to a golf practice aid which allows the golfer to estimate the distance and direction of a struck ball, while using a limited space, not compromising the feel and rotation of the ball and allowing for the golf ball to come to rest near its original striking position. In the preferred embodiment of the invention, a mass freely rests upon a flat surface. A horizontal bar is inserted and secured through a hole through the mass, extending equidistantly from the center of gravity of the mass. A cord is secured to spaced-apart points on the bar, preferably at opposite ends of the bar. A golf ball is secured to the cord, by virtue of the cord passing through a hole through the center of the golf ball, with keepers to prevent the golf ball from sliding any significant distance along the cord. The hole through the golf ball preferably is large enough to allow the ball to spin on its axis around the cord when struck. The ball is placed at the apex of the extended cord and is struck in the direction of the mass. The distance and direction of the ball are assessed by the movement of the mass, rotation of horizontal bar and finish position of the ball.

12 Claims, 10 Drawing Sheets

GOLF PRACTICE AID

BACKGROUND OF THE INVENTION

1. Field of the Invention

This invention relates to an aid used to practice the striking of a golf ball with a golf club.

In order to perfect the golf swing it is necessary to observe the direction and distance of the golf ball once it is struck. Ideally this observation is done at a driving range where the golfer is able to watch the entire flight of the ball, examining its trajectory, direction and distance. Often, however, the inconveniences (i.e. location, retrieval of golf balls, expense) associated with driving ranges prevent the golfer from using them. As such, golfers turn to portable golf practice devices. The primary advantage of the portable golf practice aids is that the devices can be used in a limited space. One disadvantage associated with the portable devices is that because the ball typically is held captive, by a netting or cord attachment to the ball, ball flight and ball direction are not as easily observed. Another disadvantage is that when the ball is attached to a cord, the flight, rotation and feel of the ball are compromised.

2. Description of the Prior Art

Various portable golf practice aids are disclosed in the prior art. One type of such aids includes an apparatus for striking a golf ball into a netting. The disadvantages of this type of device are that the ball must be retrieved from the netting each time it is struck, and it is difficult to examine the flight direction and distance of the ball.

Another such device includes a golf ball which is permanently attached to a rod, by a short cord or chain, which rotates upon striking the ball. Again the disadvantage to this type of device is that it is difficult to observe the ball flight distance and direction.

Another common portable device uses a tethered ball apparatus, where the ball is attached to a cord and the cord is fixed to the ground by attaching it to a stake or some other fixed object in the ground. Examples of this type of device are shown in U.S. Pat. Nos. 5,116,059 (Pelletier), 3,494,621 (Windall) and 5,560,604 (Watts). This type of practice device has several disadvantages associated with it. Firstly, a surface that is suitable for grounding a stake or other fixed object is required, thus making use of such a type of device indoors or on concrete rather difficult if not impossible. Secondly, if using a cord that is fixed to the ground, the cord itself must be highly durable in order to absorb the forces associated with striking a ball, while at the same time being light in weight in order to maximize the realism associated with the ball flight once struck. This has been difficult to achieve. Thirdly, the anchoring of the cord to the ground and the attachment to the ball are difficult to maintain due to the forces associated with striking the golf ball. The prior art discloses an attachment where the cord is secured to the ball by a single link. In such a single link attachment, the characteristics of composition and/or mass and/or shape of the golf ball may be significantly changed to permit the link to be joined to the golf ball. Another disadvantage to this type of attachment is that because the ball is secured to the cord, it is not allowed to spin freely, thus further diminishing the realism associated with ball flight and motion. In order to spread the force of the golf ball away from the connections at the stake and the ball, many of these tethered ball devices use an elastic or partially elastic cord. The safety hazards associated with using an elastic tethered cord are significant. When the ball is struck, the elastic cord to which the ball is attached extends to its maximum length at which point it rebounds to the original striking position or further at a high velocity, potentially causing danger to the golfer.

Other prior art, e.g. U.S. Pat. No. 5,560,604 (Watts) discloses an attachment mechanism where the cord is inserted through a hole in the center of the ball and is spliced to another part of the cord forming a loop. The advantage to this attachment mechanism over the balls which are attached at one point to the cord is that having the aperture extend through the center of the ball does not cause as rapid a deterioration and distortion of the ball as the single attachments. This patent, however, discloses an attachment that does not allow the ball to spin freely around the cord, thus lessening the realism associated with striking the ball.

Another invention, shown in U.S. Pat. No. 3,298,232 (Carboni) discloses a golf practice aid using a ball attached to a tethered cord which itself is attached to a heavy mass, consisting of a heavy block, anchoring block and trailing bar, which are not fixed to the ground. When struck, the ball flies to the end of the cord's length at which point the energy of the ball is transmitted to the heavy block apparatus, which is dragged slightly forward and left or right depending on the direction of the ball. The movement of the block and trailing bar gives the golfer an indication of the approximate distance and direction the ball flies. The trailing bar's lateral movement is limited by a fixed guide, thus limiting the assessment of lateral ball flight. Full analysis of the golf swing requires an aid which reliably assesses a wide range of lateral movement of the golf ball.

SUMMARY OF THE INVENTION

It is an object of the invention to improve on the prior art by creating a portable golf practice aid suitable for use in very limited space both indoors and outdoors, on various surfaces. It is a further object of the invention to create a golf practice aid which allows the golf ball to spin on its axis in order to maintain a realistic feel to the golf ball. It is an additional object of the invention to create a golf practice aid which reliably indicates the direction and the approximate distance of the ball once struck, thus allowing the golfer to improve his or her golf swing, and which returns the ball to adjacent to the striking position.

In the preferred embodiment of the invention, a mass freely rests upon a preferably uniform flat surface. A horizontal bar is inserted through a hole through the center of the mass, extending laterally equidistantly from the center of gravity of the mass. The bar is free to rotate around its longitudinal axis and keepers prevent the bar from sliding through the hole. The horizontal bar extends parallel to the flat surface upon which the mass rests. A cord, preferably made of nylon, is secured to spaced-apart points on the bar, preferably at opposite ends of the bar. The cord is substantially longer than the distance between the spaced-apart cord attachment points, so as to define with the bar an isosceles triangle when the cord is fully extended, with an apex between "arms" of the cord. A golf ball is secured to the cord at the apex, preferably by virtue of the cord passing through a hole through the center of the golf ball, with means to prevent the golf ball from sliding any significant distance along the cord from the apex. The hole through the golf ball preferably is large enough to allow the ball to spin on its axis around the cord when struck.

In alternative embodiments, the mass may be evenly dispersed along the bar, or may constitute the bar, or there may be separate masses along the bar, for example at opposite ends thereof.

To use this golf practice aid, the cord is fully extended, i.e. away from the bar, the ball is placed on the ground at the apex, and the golfer strikes the ball, propelling it toward the center of gravity of the mass. The energy of the ball is transferred in part to the mass which is thus dragged forward by the ball. Otherwise, this energy would be absorbed by the cord and ball attachment points, causing stress to the attachment points. Lateral movement of the golf ball results in rotation of the horizontal bar about its central axis, and thus in rotation of the mass around its central axis. Lateral movement is also indicated by the position at which the golf ball comes to rest. The weight of the mass and degree of friction between the mass and the surface upon which it rests, will be such that the distance and direction of the struck golf ball can be reliably assessed by the amount of movement of the mass on the surface. The mass should not be so heavy as to not slide or rotate on the surface when the ball is struck. At the same time it should not be so light as to allow too large an amount of sliding and rotation which would prevent reliable assessment of the ball's distance and direction.

This invention allows the golfer to estimate the approximate distance and direction that the ball would travel if it were not attached to the cord, while using a limited space and not compromising the feel and rotation of the ball once it is struck. This invention also allows for the golf ball to come to rest near its original striking position.

Further features of the invention will be described or will become apparent in the course of the following detailed description.

BRIEF DESCRIPTION OF THE DRAWINGS

In order that the invention may be more clearly understood, the preferred embodiment thereof and an alternative embodiment will now be described in detail by way of example, with reference to the accompanying drawings, in which.

DETAILED DESCRIPTION OF THE PREFERRED EMBODIMENT

Figure 1:
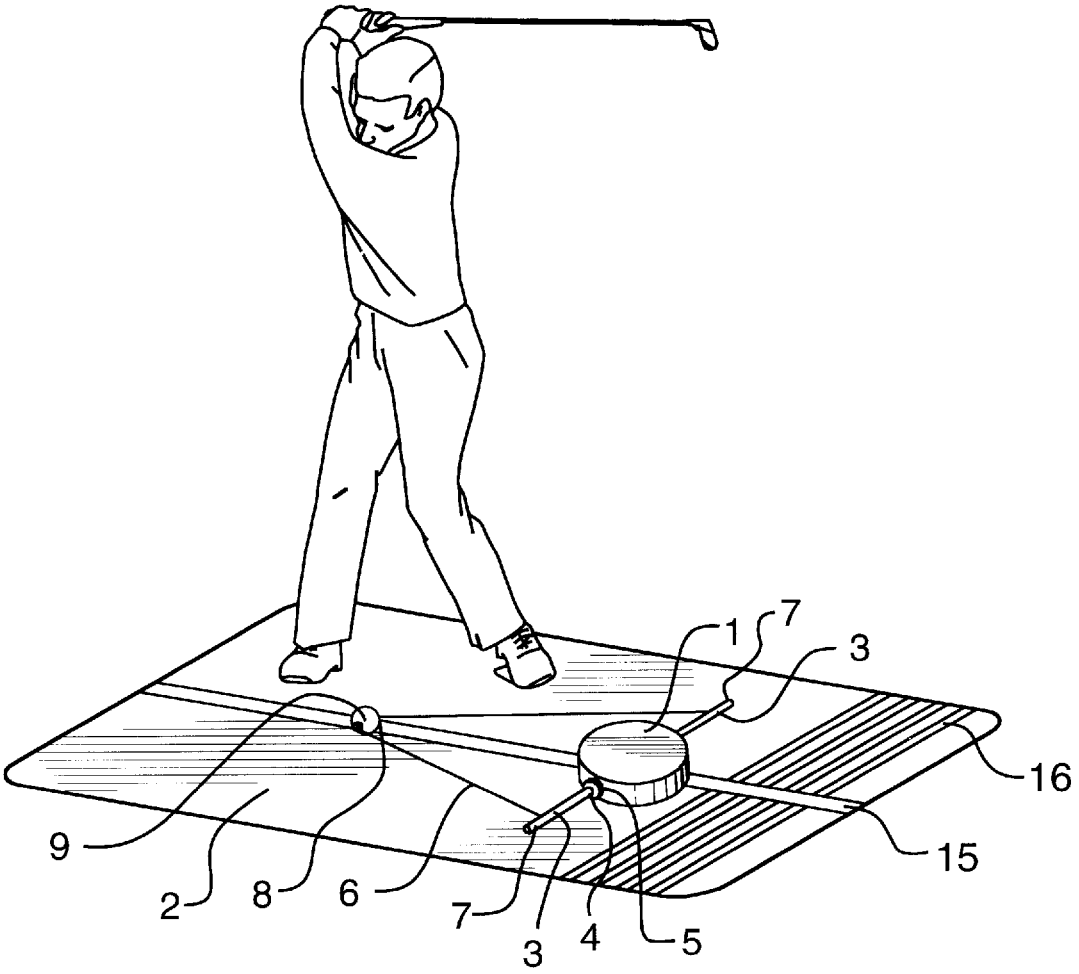
FIG. 1 is a perspective view of the preferred embodiment of the invention in use with the golfer at the top of the back swing.
Figure 2:
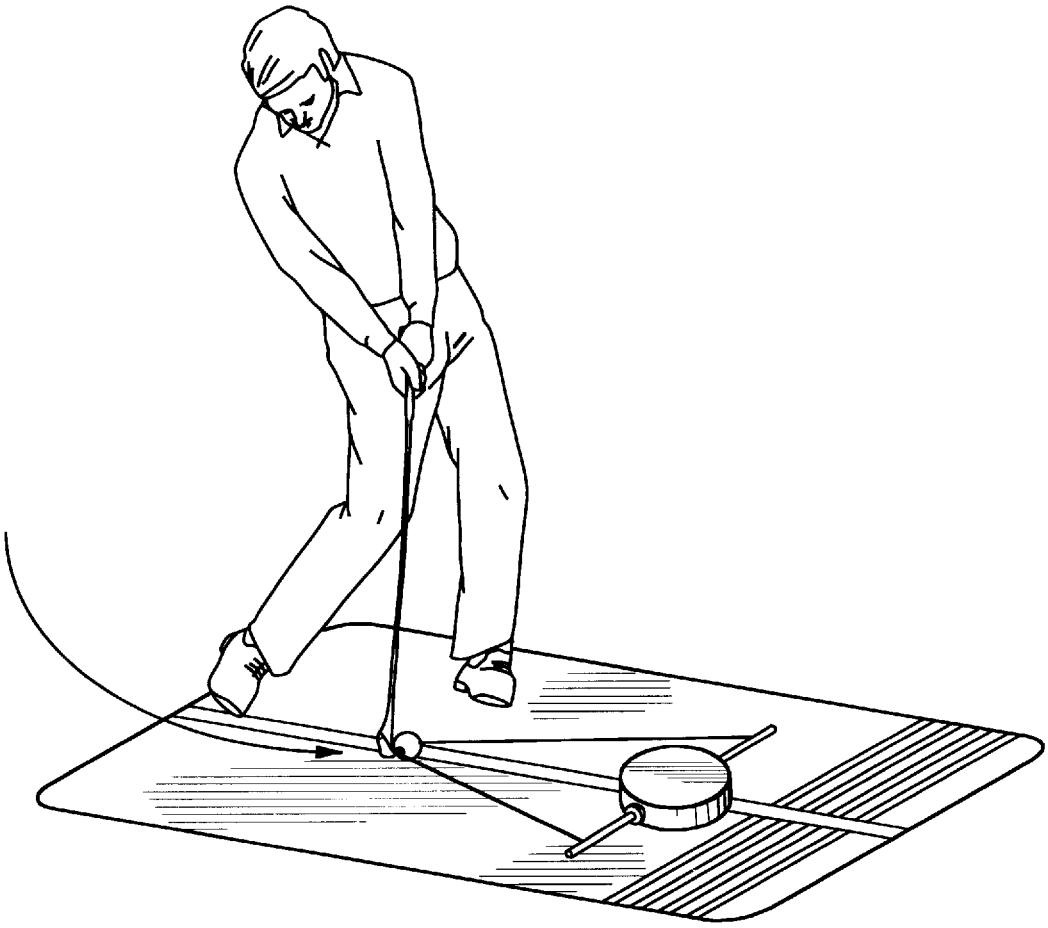
FIG. 2 is a perspective view of the preferred embodiment of the invention in use as the golf ball is being struck.
Figure 3:
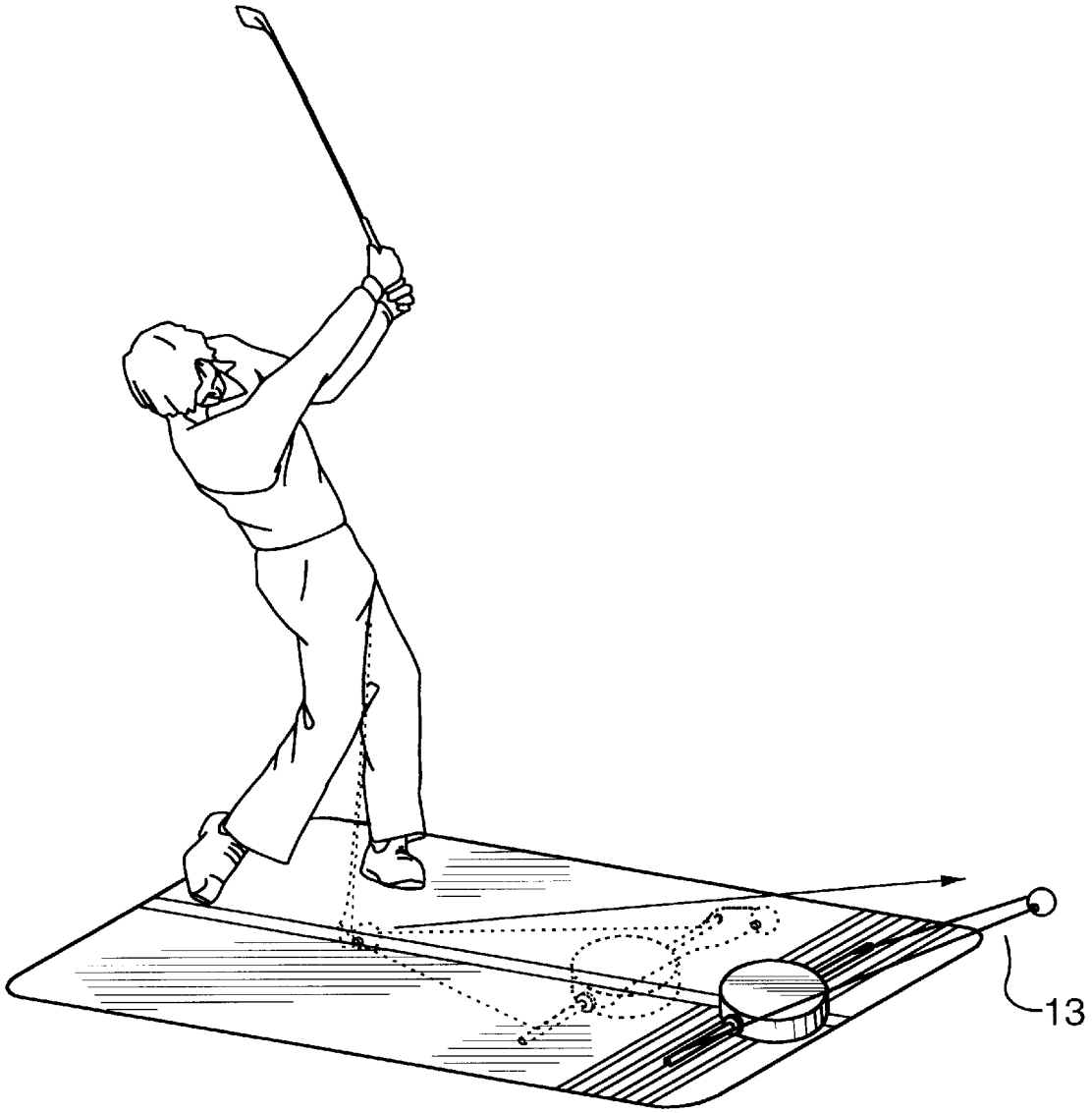
FIG. 3 is a perspective view of the preferred embodiment of the invention in use after the ball has been struck.
Figure 4:
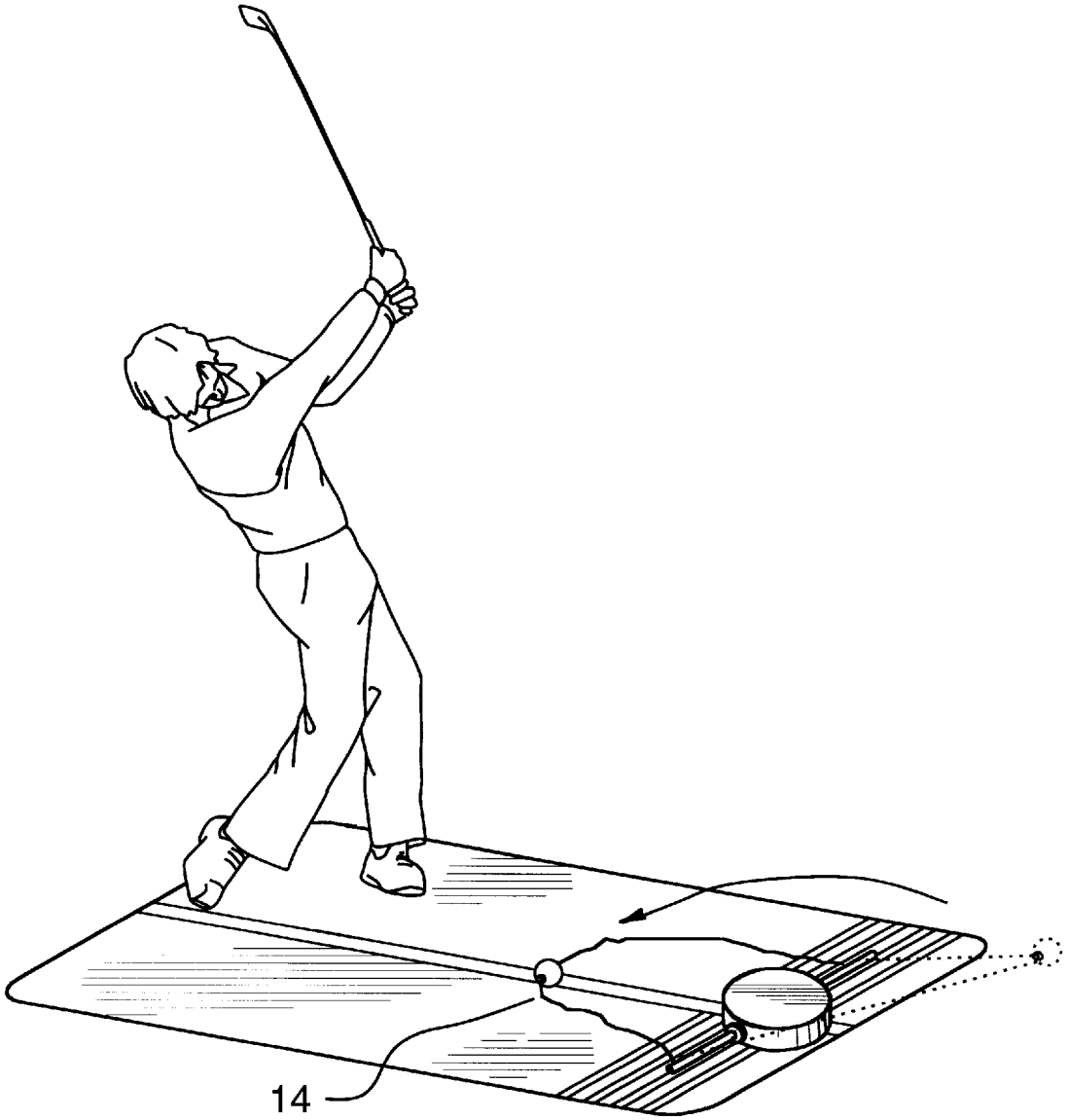
FIG. 4 is a perspective view of the preferred embodiment of the invention in use with the ball in the finish position.
Figure 5:
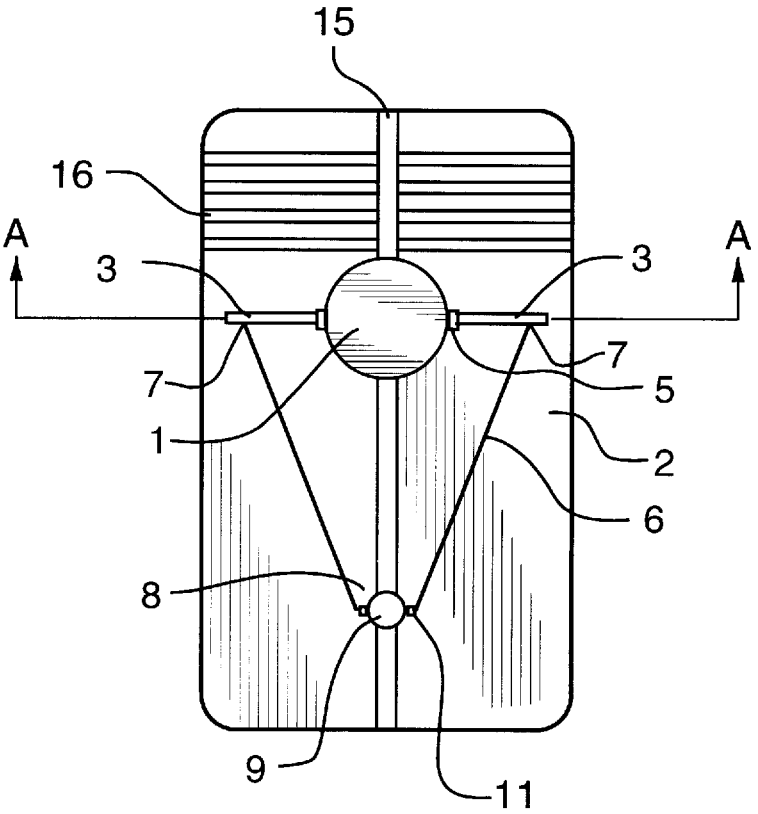
FIG. 5 is top view of the preferred embodiment of the invention.
Figure 6:
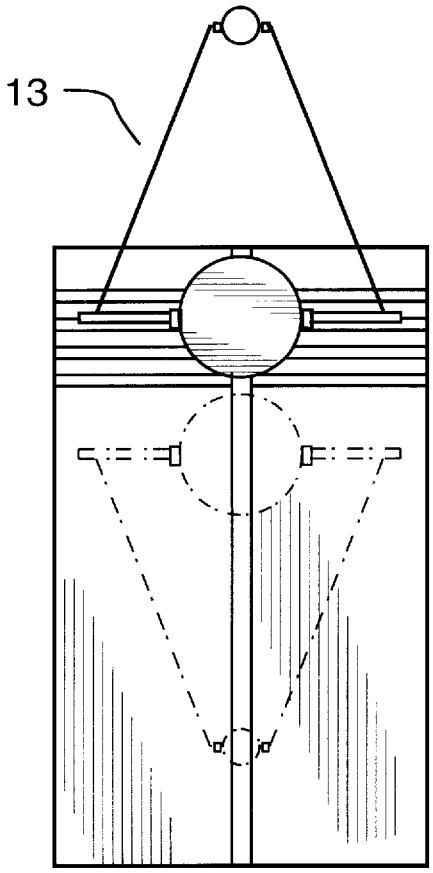
FIG. 6 is a top view of the preferred embodiment showing the ball before and after it has been struck along the direction of the longitudinal marking line.
Figure 7:
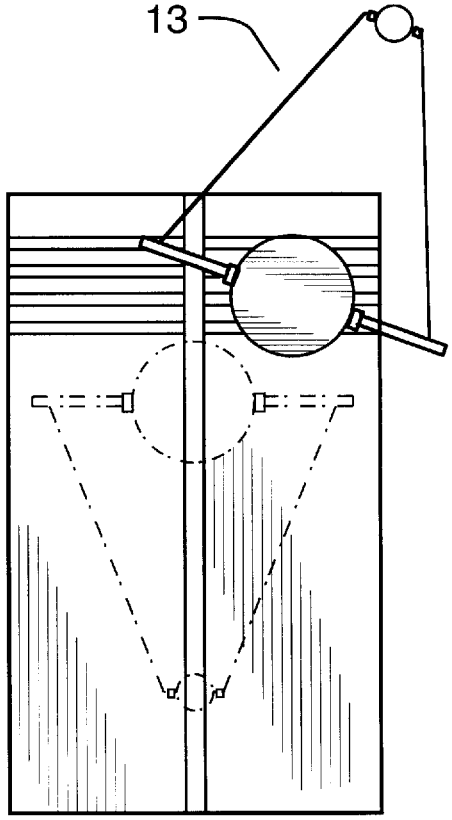
FIG. 7 is a top view of the preferred embodiment showing the ball before and after it has been struck to the right of the longitudinal marking line.
Figure 8:
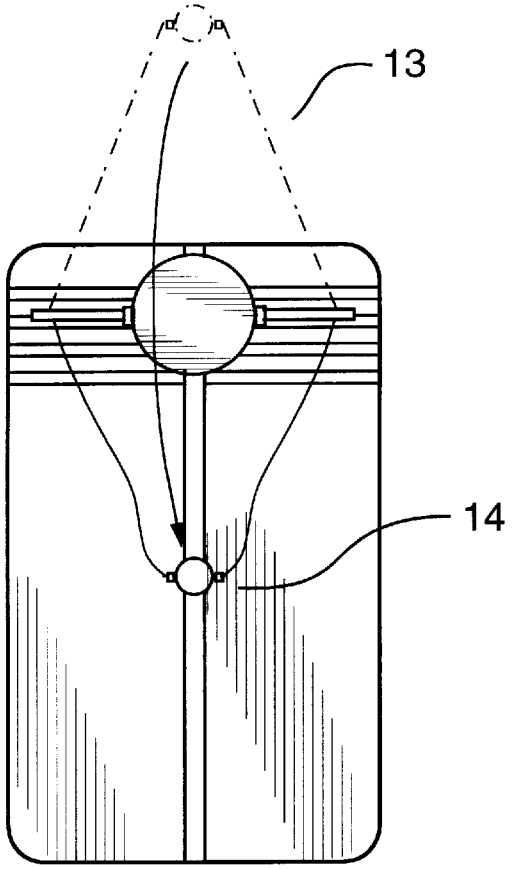
FIG. 8 is a top view of the preferred embodiment showing the ball after it has been struck along the direction of the longitudinal marking line and showing the ball in a finish position.
Figure 9:
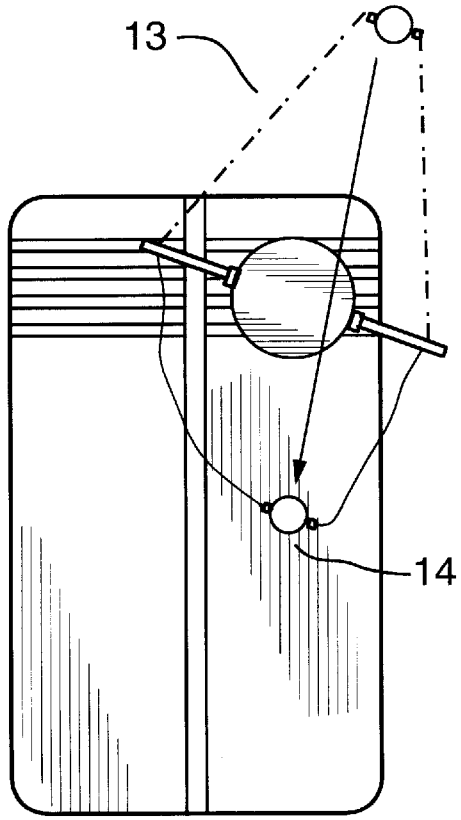
FIG. 9 is a top view of the preferred embodiment showing the ball after it has been struck to the right of the longitudinal marking line and showing the ball in a finish position.

In the preferred embodiment of the invention, as shown in FIGS. 1 to 9, a mass 1 freely rests upon a uniform flat surface 2. A horizontal bar 3 is secured to the mass by being inserted through a hole 4 through the center of the mass and is fastened in place with fasteners 5 at each opening of the hole. While the bar is secured it is not rigidly anchored. The fasteners prevent the bar from sliding through the hole and the bar is free to rotate within the hole around its longitudinal axis. This rotation allows the kinetic energy of the ball to cause the mass to be dragged forward along the surface, rather than to cause the bar and mass to topple over and allows some of the energy that would be absorbed by the cord attachment points to be dissipated. The horizontal bar is somewhat flexible in order to allow some of kinetic energy of the ball to further dissipate away from the points of attachment of the cord to the bar. The bar extends equidistantly from the center of gravity of the mass and parallel to the flat surface upon which the mass rests. A cord 6 is secured to the adjacent distal ends 7 of the horizontal bar. The cord is substantially longer than the horizontal bar so as to define with the bar an isosceles triangle when the cord is fully extended, with an apex 8 between "arms" of the cord. The preferred angle of the apex is approximately 50 degrees. It has been found that the invention functions optimally at this preferred angle with respect to rotation of the horizontal bar, ball flight and movement of the mass. The invention also functions effectively at angles of the apex ranging from 20 to 100 degrees. If it is preferred to use less space for the invention, the angle of the apex can be as high as 100 degrees, and if it is preferred to use more space, in order to observe a longer ball flight, the angle can be as low as 20 degrees.

Figure 10:
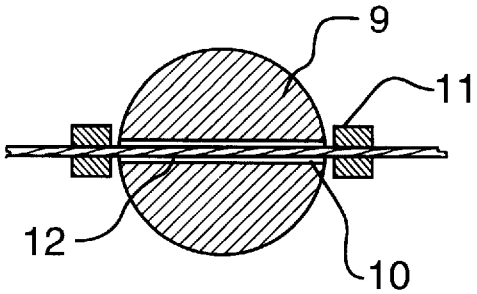
FIG. 10 is a close up cross section view of the golf ball attached to the apex of the cord.
Figure 11:
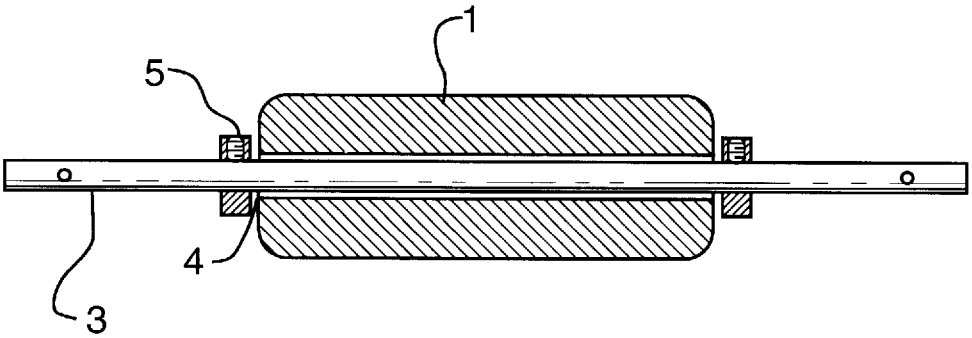
FIG. 11 is cross section at line A—A of FIG. 5.

As shown in FIG. 10, a golf ball 9 is secured to the cord by virtue of the cord passing through a hole 10 through the center of the golf ball, with a means to prevent the golf ball from sliding any significant distance along the cord from the apex. In the preferred embodiment the means consists of keepers 11 on either side of the ball. The hole through the golf ball is large enough to provide some space 12 between the ball and cord in order to allow the ball to spin on its axis around the cord when struck.

To use this golf practice aid, the cord is fully extended to its apex 8, the ball is placed on the ground at the apex, on a surface suitable for striking the golf ball (e.g. artificial turf, a mat or a rubber tee). As illustrated in FIGS. 1 to 4, the golfer strikes the ball, propelling it toward the mass. The ball extends the cord to its full length 13. The kinetic energy of the ball is absorbed by the mass which is dragged forward by the ball. Lateral movement of the golf ball results in the rotation of the horizontal bar about its central axis, resulting in rotation of the base about its central axis. Lateral movement is also indicated by the final resting position 14 of the golf ball at a point to the left or right of the original striking position. The weight of the mass and degree of friction between the mass and the surface upon which it rests, will be such that the distance and direction of the struck golf ball can be reliably assessed by the amount of movement of the mass on the surface, and by the rotation of the bar about its central axis.

As an aid to visual evaluation of the movement of the base and bar by the propelled golf ball, a longitudinal line 15 and perpendicular lines 16 may be placed along the surface. A mat with such markings may be provided as part of the invention. The device is positioned on the surface with the center of the mass placed on the longitudinal line and the horizontal bar parallel to the lines perpendicular to the longitudinal line. The golf ball is positioned on the longitudinal line distal to the base and is propelled towards the center of the mass. The perpendicular lines provide reference lines for evaluating the displacement of the base, indicating distance travelled by the ball and the longitudinal line reflects the rotation of the horizontal bar about its central axis, indicating the direction of the ball. The device may be calibrated such that the distance that the mass is dragged, and the rotation of the bar reflect approximate distance and direction that the ball would fly if it was not attached to the cord.

It will be appreciated that the above description relates to the preferred embodiment by way of example only. Many variations on the invention will be obvious to those knowledgeable in the field, and such obvious variations are within the scope of the invention as described and claimed, whether or not expressly described.

Figure 12:
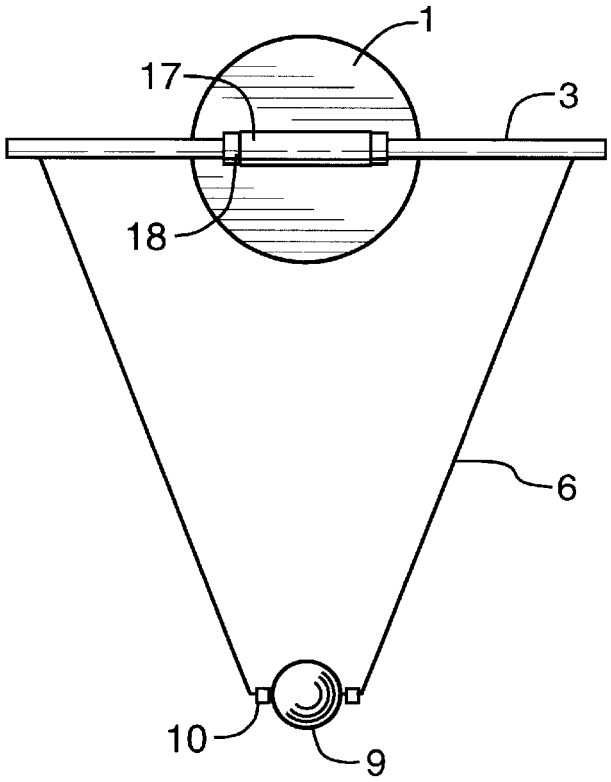
FIG. 12 is a top view of an alternate embodiment of the invention.
Figure 13:
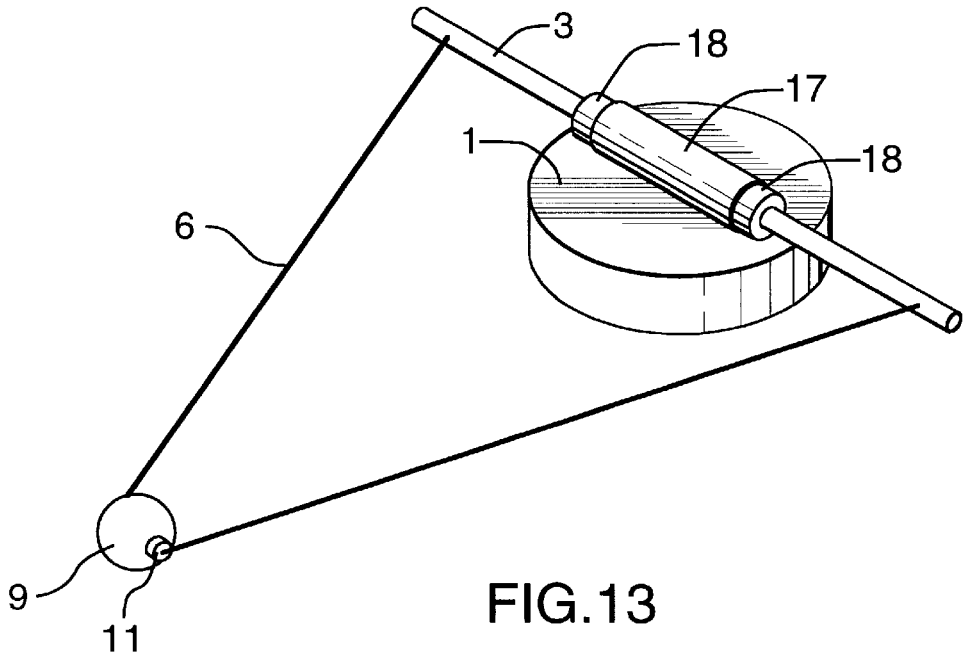
FIG. 13 is a perspective view of the alternate embodiment of the invention corresponding to FIG. 12.
Figure 14:
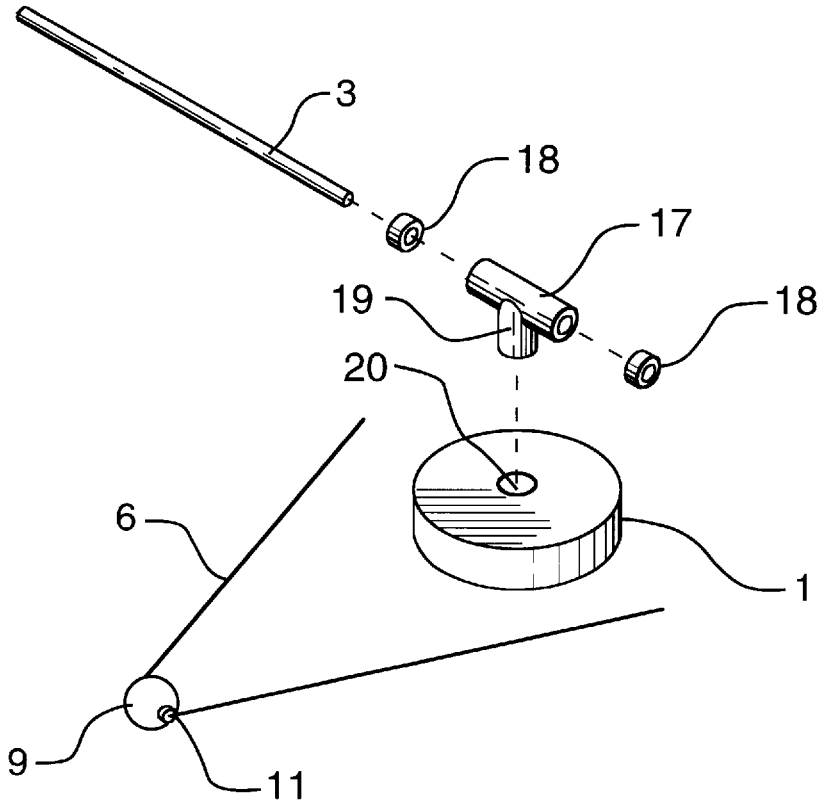
FIG. 14 is an assembly view of the alternate embodiment of the invention corresponding to FIG. 12.

For example, in an alternate embodiment of the invention as shown in FIGS. 12 to 14, the horizontal bar 3 is inserted through a tube 17 which rests on the top of the mass 1. The bar is fixed in place with a fastener 18 on each end of the tube. The tube has a member 19 which extends from the center of the tube, perpendicular to the bar. The tube is attached to the mass by inserting the member into an opening 20 in the upper surface of the mass at the center of the mass. The tube is fixed in the opening with adhesive means. The fasteners prevent the bar from sliding through the tube and the bar is free to rotate within the tube around its longitudinal axis.

In another alternate embodiment of the invention, not specifically illustrated, the horizontal bar is attached to a mass by resting within a groove on the upper surface of the mass, and is fixed in place with any suitable means, such as series of fasteners.

In another alternate embodiment of the invention, an additional cord is attached to the cord at its apex. The golf ball is affixed to this additional cord at its end. This allows for the ball the travel further, while still being able to reliably measure the distance and direction of the ball.

An additional alternate embodiment has a horizontal bar secured between two masses. This embodiment assesses the distance of the ball flight by the forward movement of both of the masses. Direction of the ball flight is measured by the difference between the distance each mass is dragged forward.

A further alternate embodiment has the mass incorporated within the entire length of horizontal bar, i.e. the bar itself may have a substantial mass.

Additionally, the invention may use various different lengths of cord and/or different lengths of the horizontal bar as well as different means by which the ball is attached to the cord.

What is claimed as the invention is:

1. A golf training device, comprising:

a mass;

a horizontal bar secured to said mass, opposite ends of said bar extending generally equidistantly from the center of gravity of said mass;

a cord secured to spaced-apart attachment points on the bar, equidistant from said center of gravity of said mass, said cord being substantially longer than the distance between said attachment points, thereby defining with said bar an isosceles triangle when the cord is extended, with an apex remote from said bar; and a golf ball secured to said cord at said apex.

2. A golf training device as recited in claim 1, where said apex has an interior angle in the range of 20 to 100 degrees.

3. A golf training device as recited in claim 1, where said apex has an interior angle of approximately 50 degrees.

4. A golf training device as recited in claim 1, where said bar is somewhat flexible.

5. A golf training device as recited in claim 1, where said golf ball is secured to said cord by virtue of said cord passing through a hole through the center of said golf ball, whereby the ball is free to spin on its central axis around the cord, and with means to prevent said golf ball from sliding any significant distance along said cord from said apex.

6. A golf training device as recited in claim 1, where said golf ball is secured to said cord by virtue of an additional cord of variable length attached to the said apex of the said cord.

7. A golf training device as recited in claim 1, where said horizontal bar rests within a groove on the upper surface of said mass, with a means to attach said horizontal bar to said mass.

8. A golf training device as recited in claim 1, where said horizontal bar is inserted through a hole through the center of said mass, whereby said bar is free to rotate around its longitudinal axis, and with a means to prevent said bar from sliding through said hole.

9. A golf training device as recited in claim 1, where said spaced-apart attachment points are generally at opposite ends of said bar.

10. A golf training device comprising:

a mass;

a horizontal bar;

a tube, through which said horizontal bar is inserted, having a member extending from the center of said tube, perpendicular to said tube; said tube resting adjacent to the upper surface of said mass; said member being inserted into an opening through the upper surface of said mass at the center of said mass and said member being fixed in said opening;

a cord secured to spaced-apart attachment points on the bar, equidistant from the center of gravity of said bar, said cord being substantially longer than the distance between said attachment points, thereby defining with said bar an isosceles triangle when the cord is extended, with an apex remote from said bar; and a golf ball secured to said cord at said apex.

11. A golf training device, comprising:

a heavy horizontal bar;

a cord secured to spaced-apart attachment points on the bar, equidistant from the center of gravity of said bar, said cord being substantially longer than the distance between said attachment points, thereby defining with said bar an isosceles triangle when the cord is extended, with an apex remote from said bar; and a golf ball secured to said cord at said apex.

12. A golf training device, comprising:

an assembly having two equal masses; and a horizontal bar secured between said masses;

a cord secured to spaced-apart attachment points on said assembly, equidistant from the center of said bar, said cord being substantially longer than the distance between said attachment points, thereby defining with said bar an isosceles triangle when the cord is extended, with an apex remote from said bar; and a golf ball secured to said cord at said apex.

* * * * *